US010532796B2

(12) United States Patent
Knutsen et al.

(10) Patent No.: US 10,532,796 B2
(45) Date of Patent: Jan. 14, 2020

(54) TRANSFER STRUCTURE, A TRANSFER SYSTEM AND A METHOD FOR TRANSFERRING LNG AND/OR ELECTRIC POWER

(71) Applicant: Connect LNG AS, Drammen (NO)

(72) Inventors: David Mikal Knutsen, Oslo (NO); Stian Tunestveit Magnusson, Bønes (NO); Magnus Eikens, Oslo (NO); Andreas Norberg, Vestskogen (NO); Kjetil Sjølie Strand, Lier (NO)

(73) Assignee: CONNECT LNG AS, Drammen (NO)

( * ) Notice: Subject to any disclaimer, the term of this patent is extended or adjusted under 35 U.S.C. 154(b) by 0 days.

(21) Appl. No.: 15/108,392

(22) PCT Filed: Jan. 16, 2015

(86) PCT No.: PCT/EP2015/050765
§ 371 (c)(1),
(2) Date: Jun. 27, 2016

(87) PCT Pub. No.: WO2015/107147
PCT Pub. Date: Jul. 23, 2015

(65) Prior Publication Data

US 2016/0318585 A1 Nov. 3, 2016

(30) Foreign Application Priority Data

Jan. 17, 2014 (NO) ..... 20140063

(51) Int. Cl.
*B63B 22/02* (2006.01)
*B63B 27/24* (2006.01)
*B63B 27/34* (2006.01)

(52) U.S. Cl.
CPC ..... *B63B 27/24* (2013.01); *B63B 22/023* (2013.01); *B63B 27/34* (2013.01)

(58) Field of Classification Search
CPC ..... B63B 21/50; B63B 22/023; B63B 27/24; B63B 27/34; B63B 27/36; B63B 35/44;
(Continued)

(56) References Cited

U.S. PATENT DOCUMENTS 3,712,330 A * 1/1973 Davis ..... B67D 9/02 137/312
6,805,598 B2 * 10/2004 Goldbach ..... B65D 88/78 114/74 R (Continued)

FOREIGN PATENT DOCUMENTS

JP 03-31098 2/1991
JP 2006-290263 10/2006

(Continued)

OTHER PUBLICATIONS

International Search Report dated Apr. 2, 2015 in International (PCT) Application No. PCT/EP2015/050765.

(Continued)

*Primary Examiner* — Daniel V Venne
(74) *Attorney, Agent, or Firm* — Wenderoth, Lind & Ponack, L.L.P.

(57) ABSTRACT

A transfer structure for transfer of a fluid between a floating structure and a floating or non-floating facility and/or transmission of electric power between the floating or non-floating facility and the floating structure is disclosed. The transfer structure includes at least one attachment means passive-movably mounted relative to the transfer structure for releasable attachment of the transfer structure to the floating structure. The transfer structure is semi-submersible and floating.

28 Claims, 11 Drawing Sheets

(58) Field of Classification Search
CPC ..... B63B 2021/003; B63B 2021/005; B63B 2021/006; B63B 2021/50; B63B 2035/44; B63B 2035/442; B63B 2035/4473; B63B 2035/448; B63B 2035/4486
USPC ..... 114/256, 264–267, 72, 73, 74 R, 230.1, 114/230.15, 133; 441/133, 4; 414/137.1, 414/137.9, 138.1, 138.2, 138.5
See application file for complete search history.

(56) References Cited

U.S. PATENT DOCUMENTS

| | | | | |
|---|---|---|---|---|
| 8,104,416 | B1 * | 1/2012 | Shivers, III | B63B 27/24 114/230.14 |
| 8,104,417 | B1 | 1/2012 | Shivers, III et al. | |
| 8,266,678 | B2 * | 9/2012 | Scurlock, Jr. | G06F 21/33 726/10 |
| 8,286,678 | B2 | 10/2012 | Adkins et al. | |
| 9,409,631 | B2 * | 8/2016 | Høvik | B63B 27/24 |
| 2004/0216485 | A1 | 11/2004 | Landry et al. | |
| 2007/0022934 | A1 | 2/2007 | Lee et al. | |
| 2010/0218710 | A1 | 9/2010 | Feger | |
| 2011/0253023 | A1 * | 10/2011 | Tahar | B63B 35/4413 114/264 |
| 2012/0114421 | A1 * | 5/2012 | Van Den Haak | B63B 35/4413 405/200 |
| 2013/0283825 | A1 * | 10/2013 | Bernays | B63B 35/44 62/53.2 |
| 2014/0299214 | A1 * | 10/2014 | Bardi | G03F 7/3071 137/899.2 |

FOREIGN PATENT DOCUMENTS

| | | |
|---|---|---|
| JP | 2008-195114 | 8/2008 |
| JP | 2009-530174 | 8/2009 |
| RU | 2359859 | 6/2009 |
| WO | 2006/054180 | 5/2006 |
| WO | 2011/008590 | 1/2011 |

OTHER PUBLICATIONS

Office Action dated Jun. 1, 2017 in corresponding Chinese patent application No. 2015800046544, with English translation.

* cited by examiner

Operational mode

Idle mode

TRANSFER STRUCTURE, A TRANSFER SYSTEM AND A METHOD FOR TRANSFERRING LNG AND/OR ELECTRIC POWER

BACKGROUND OF THE INVENTION

1. Field of the Invention

The present invention is related to transfer of fluids between a floating structure, such as a liquefied natural gas (LNG) carrier, and a floating or non-floating facility and to transmission of electric power between the floating or non-floating facility and the floating structure.

The present invention is particularly suited for use in shallow water and for cryogenic purposes due to the challenges related to the large weight of insulated transfer ducts for cryogenic applications and the facilitation of convenient purging and precooling. The invention will presumably be a suitable alternative for fairly protected waters where environmental conditions are not as harsh as in open waters.

The present invention may also be used for transfer of electric power to or from a vessel, such as a cruise ship, which may need an additional supply of electric power when it arrives at a destination which does not have the required harbor facilities to receive large ships.

2. Description of the Related Art

Transfer of temperate fluids from ship to shore is today achieved, among other methods, through a submerged flexible hose, which is lifted from the seabed and connected directly to the vessel manifold. To avoid excessive heat loss and accumulation of an external ice layer, the transfer of cryogenic liquids through any pipe in contact with water requires the pipe to be extensively insulated, resulting in a considerably larger weight per meter than pipes for transfer of temperate fluids. The handling of pipes for cryogenic applications will therefore often be unmanageable for the ship's lifting equipment and manifold. Furthermore, the transfer of cryogenic liquids requires precooling of transfer ducts to avoid extensive vapor generation. The precooling must be conducted immediately prior to the transfer operation, and the operation must commence shortly after arrival of the distribution carrier for cost-efficient shipping. Moreover, the handling of many cryogenic fluids requires the implementation of special measures to minimize the risk of a spill in any event of failure. Emergency shut down systems, emergency release couplings, and special monitoring systems are often an extensive integration of a cryogenic transfer operation.

The use of loading systems comprising various types of floating concepts is widely used in the offshore petroleum industry. Environmental conditions offshore are often harsh, which significantly increases the requirements and costs for systems to operate in these conditions.

In U.S. Pat. No. 8,286,678 B2, there is disclosed a fluid transfer apparatus for accommodating fluid transfer between a transfer vessel and a transport vessel, comprising a mooring device capable of being releasably attached to the transport vessel, where the mooring device supports a fluid conduit adapted to be connected to the transport vessel.

In more detail, the fluid transfer apparatus comprises a positioning arm, mounted on the transfer vessel and controlled by a hydraulic system, and truss work which is attached to the positioning arm such that the truss work can be moved in all six degrees of freedom when the truss work is being moved into a desired position. To the truss work, mooring pads are attached for attachment of the truss work to the hull of the transport vessel. Thus, the truss work is actively controlled and moved by the positioning arm when the truss work is to be attached to the transport vessel. Furthermore, it is the truss work only which is moored to the transport vessel. The transfer vessel moves freely relative to the transport vessel during transfer of the fluid and is kept in position by a dynamic positioning thruster system. Such a dynamic positioning system increases both the initial costs and the operating costs of the vessel considerably.

Furthermore, there are several problems associated with this deployment system. The deployment system increases the transfer vessel topside weight. The deployment system including the positioning arm and the truss work is a complex system and therefore significantly increases both initial and operational costs and is more prone to failure during operation. Furthermore, for the fluid conduit to be supported on the mooring system, the mooring device must attach to a very upper portion of a floating structure freeboard which unfavorably increases the weight-altitude on the transfer vessel for given dimensions.

SUMMARY OF THE INVENTION

The objective of the present invention has been to mitigate the problems described above.

In particular, it has been an objective to provide a system which can be used to transfer fluid and/or to transmit electric power between a floating structure and a floating and/or non-floating structure.

Furthermore, it has been an objective to provide a system which is suitable for use in fairly protected waters where wind and weather conditions are not as severe as on the open sea, and in shallow water.

It has further been an objective to provide a system for transfer of fluid and/or electric power which has a simpler construction and has lower construction costs and operational costs than known transfer systems.

There is provided a semi-submersible, floating transfer structure for transfer of a fluid between a floating structure and a floating or non-floating facility and/or transmission of electric power between the floating or non-floating facility and the floating structure. The transfer structure comprises at least one attachment means mounted to the transfer structure for releasable attachment of the transfer structure to the floating structure, the at least one attachment means being mounted passive-movably relative to the transfer structure.

The floating structure may be a seagoing vessel carrying a fluid, such as LNG or some other type of vessel, such as a cruise ship, or a platform.

The floating or non-floating facility is a facility which may be a vessel, for example, a tanker, if it is a floating facility. If the facility is non-floating, it may, for example, be a facility based on land or on a pier comprising elements which is fixed to the bottom of the sea. If the transfer structure is used to transfer a fluid, the floating or non-floating facility typically comprises at least storage means for fluid, for example, storage tanks, and storage means for at least one transfer line which connects the storage means and the transfer structure during a transfer operation of the fluid. If the transfer structure is used for transmission of electric power between the floating structure and the floating or non-floating facility, possibly in combination with transfer of fluid, the floating or non-floating facility comprises a source of electric power, typically the electricity grid, to which the transfer line may be connected for transmission of electric power to the floating structure. Transmission of electric power from the floating structure to the floating or non-floating facility may also take place. The floating structure will in this case comprise a source of electric power, such as one or more generators.

Preferably, the transfer structure is a shallow-water transfer structure. This means that the transfer structure is particularly suitable for use in water where the depth is small. Preferably, the transfer structure has a maximum draft in still water which is less than 5 meters. In coastal and inshore waters, the environmental conditions are generally much milder, enabling a significant reduction in requirements and costs for installations to operate in these conditions. The present invention, having a small draft, is therefore highly suitable for milder environmental conditions and shallow-water applications.

The passive-movable attachment means is designed such that the attachment means or the transfer structure does not comprise any means for actively changing the position of the attachment means relative to the platform, i.e., the at least one attachment means is mounted to the transfer structure passive-movably relative to the transfer structure. Only external forces, i.e., from the floating structure, acting on the attachment means will change the position of the attachment means relative to the transfer structure.

The attachment means preferably comprises one or more vacuum pads and/or electromagnetic pads, but the attachment means may comprise any means which can be used to releasably attach the transfer structure to a side of the floating structure, such as the hull of a ship, during the transfer operation.

The transfer platform also serves the purpose of absorbing the tensional forces in the at least one transfer line, arising from environmental loads acting on the at least one transfer line such as wind, waves and currents, and distributing these forces safely through the attachment means to the hull of the floating structure to which it attaches.

The present invention, therefore, will be particularly useful for the transfer of cryogenic liquids such as for example, LNG, liquefied petroleum gas (LPG), liquefied carbon dioxide, or liquefied nitrogen. The present invention will also offer an effective and safe alternative for the transfer of various other media such as, for example, liquid bulk materials, petrochemical products, electricity, water or gas.

Furthermore, in the case of transfer of a cryogenic fluid, to avoid extensive vapor generation, the transfer platform enables precooling of transfer ducts before the transfer of the cryogenic fluid commences. The use of the transfer structure means that precooling can be conducted immediately prior to the transfer operation and that the operation can commence shortly after arrival of the distribution carrier. The transfer platform also enables implementation of all required safety equipment such as emergency shut down systems, emergency release couplings and special monitoring systems.

Preferably, the passive-movable attachment means allows free relative vertical translational movement and relative rotation of the transfer structure about a horizontal axis, and passively restrains relative horizontal translation and relative rotation between the floating structure and the transfer structure about a vertical axis.

The transfer structure is further adapted for relocation and positioning by external relocation and positioning means. The transfer structure is preferably non-motorized which means that the transfer structure has no propulsive means for relocating or positioning of the transfer vessel in water. In order to relocate the transfer structure between an operational and a non-operational period, and to position the transfer structure relative to the floating structure during the procedure of attachment to or detachment from the floating structure, the transfer structure is provided with external relocation and positioning means. For example, the transfer structure may be provided with berth means including a truss structure comprising one or more fenders; and anchoring means for a vessel, for example attachment means for one or more winch wires in the form of cleats, bitts, or bollards. Such vessels may, for instance, comprise tugs or workboats. If winches are used, a system may be provided with one winch on the floating structure for pulling the transfer structure from its docking position to the floating structure and another winch on the docking position for pulling the transfer structure from the floating structure back to its docking position. Another option would be to provide a winch on the transfer structure and a winch wire which runs in an endless loop between the transfer structure's docking position and the moored floating structure or a buoy next to the floating structure. Alternatively, as long as the water depth permits it, the transfer structure may be provided with one or more propellers for propulsion of the transfer structure.

The transfer structure preferably comprises a top-side deck and a plurality of surface piercing columns having a diameter, or a characteristic diameter, where the columns are separated by a distance which is preferably at least four times as large as the diameter or characteristic diameter. This configuration of the transfer structure is found to reduce response to wave excitations. When connecting two independent floating structures such as the transfer structure and the floating structure, small relative movements are advantageous. Large relative motions will unduly complicate the design of a connection system, complicate the connection operation and pose larger requirements for aerial hoses, consequently reducing many aspects of safety and operability. Since motions of the transfer platform will be transferred to the end termination of the pipeline, large motions of the platform will furthermore reduce the fatigue life of the pipeline. Small wave induced response of the transfer platform is therefore favorable.

The transfer structure, comprising a top-side deck and a plurality of surface piercing columns, may have columns which are provided with respective telescopic elements, for example, an extrusion, at their lower end portions, the telescopic elements being movable between an upper position and a lower position such that the columns' respective longitudinal lengths are adjustable. The columns may be provided with a storage room, i.e., a void for a fluid, each storage room being delimited by their respective columns and telescopic elements such that the storage room's volume is variable and depends on the vertical position of the telescopic element relative to the column. The telescopic elements can be displaced vertically along the columns, hence providing a variable volume of the void space within the telescopic elements which makes it possible to change the draft of the transfer structure without changing the freeboard height of the transfer structure. The vertical movement of the telescopic elements may be effectuated with a hydraulic piston/cylinder arrangement. The storage rooms are then preferably provided with at least one through-going opening to the surroundings such that water can flow in and out of the storage rooms. Alternatively, the vertical movement can be effectuated by using a pump to pump liquid into the void in order to extend the length of the columns and to pump liquid out of the void in order to reduce the length of the columns. When liquid is pumped out of the void, a vacuum effect ensures that the telescoping elements are pulled up.

The transfer structure preferably comprises a connecting device 49 to which at least one aerial transfer line can be releasably connected. The connecting device 49 is adapted for connection to at least one transfer line between the floating or non-floating facility and the transfer structure. Thus, during use of the transfer structure, fluid can flow through the aerial transfer line and the transfer line from the floating structure to the floating or non-floating facility or electric power can be transmitted through the transfer lines from the onshore facility to the floating structure. The aerial transfer line may be stored on the transfer structure or on the floating structure when no transfer of fluid or transmission of electric power is taking place. In other words, the at least one transfer line may extend between the transfer structure and the facility during transfer of the fluid and the at least one aerial transfer line may extend between the transfer structure and the floating structure during transfer of the fluid. Furthermore, the at least one transfer line may extend from a lower side of the transfer structure, the at least one aerial transfer line may extend from an upper side of the transfer structure and the lower side of the transfer structure is opposite to the upper side of the transfer structure (see FIG. 2).

For transfer of fluid between the floating structure and the floating or non-floating facility, the connecting device 49 may be a manifold to which the transfer lines can be connected for transfer of fluid between the floating structure and the floating or non-floating facility. For transmission of electricity between the floating structure and the floating or non-floating facility, the connecting device 49 may be an electrical coupling device to which the transfer lines can be connected for transfer of electrical power between the floating or non-floating facility and the floating structure.

There is also provided a transfer system for transferring a fluid between a floating structure and a floating or non-floating facility or electric power between the floating or non-floating facility and a floating structure. The transfer system comprises a semi-submersible, floating transfer structure as described above, at least one transfer line and a storage means for storing the transfer line when the transfer system is not in use. The at least one transfer line extends between the transfer structure and the storage means, and the at least one transfer line is connected to

- a storage means for fluid(s) which have been transferred from the floating structure or which is being transferred to the floating structure or
- a pipeline for fluid(s) which have been transferred from the floating structure or which is being transferred to the floating structure, or
- a source of electric power for transmission of electric power to or from the floating structure.

In congested ports and harbor areas, it is beneficial with impermanent installations that may be completely or partially removed from the harbor basin between transfer operations. The transfer system comprises a floating and moveable system which can be moved out of the way when not in use, hence reducing interference with local sea traffic and minimizing the risk of damage to the transfer pipe due to seabed interaction.

The system preferably comprises a multi-buoy mooring system to which a floating structure can be moored such that the floating structure is non-weathervaning. The multi-buoy mooring system will prevent weathervaning and hence protect the integrity of the floating transfer lines. The multi-buoy mooring system may vary in configuration and complexity, depending on local environmental conditions, incident water depth, and the size range of floating structures to use the mooring system. The multi-buoy mooring system will typically comprise appropriate anchors depending on seabed conditions, connected to surface buoys by chain or fiber rope or a combination of both.

The transfer system preferably comprises a docking facility for storing the transfer structure when it is not in use. The transfer structure is preferably moored between transfer operations, for example, to a docking station, a pier or mooring means. During a transfer operation of fluid or transmitting of electric power, the transfer structure is unmoored and attached temporarily to the floating structure.

The system may comprise a vessel for relocating the semi-submersible transfer vessel between the docking facility and the floating structure and for control of the transfer vessel during attachment to or detachment from the floating structure. The vessel is typically a tugboat or a workboat, but may be any vessel capable of relocating the transfer structure between the docking facility and the floating structure and controlling the transfer structure during the process of attaching or detaching the transfer structure to or from the floating structure. Alternatively, one or more winches may be employed to pull the transfer structure between the docking station and the moored floating structure. Alternatively, as long as the water depth permits it, the transfer structure may be provided with one or more propellers for propulsion of the transfer structure.

The transfer line is preferably flexible and the storage means for the transfer line comprises at least one reel or turntable or basket on which the transfer line may be wound when the transfer system is not in use. Alternatively, the storage means for the transfer line may comprise a plurality of rollers on which the transfer line can rest such that the transfer line may be pulled back to a storage position without being wound when the transfer system is not in use. The transfer line is preferably provided with at least one buoyancy element such that the transfer line floats on water or floats submerged in the water.

The storing means for the transfer line is preferably located onshore or on a non-floating structure, for example, a pier, or on a floating structure such as a vessel comprising storage tanks for fluid and/or transfer means enabling the transmittal of electric power, or on the transfer vessel itself. The storage means may be in the form of at least one reel such that the transfer line can be wound up on the reel. The storage means may also be in the form of a turntable or basket on which the transfer line may be wound, or rollers if the transfer line is to be stored without being wound, i.e., in a substantially straight condition.

There is also provided a method for transferring a fluid between a floating structure and a floating or non-floating facility and/or transmission of electricity between a floating or non-floating facility and a floating structure, where the method comprises the following steps:

- mooring the floating structure to a multi-buoy mooring system such that the floating structure is non-weathervaning,
- relocating a semi-submersible, floating transfer structure as described above from a docking facility to the moored floating structure, and subsequently or simultaneously paying out a transfer line through which fluid is to be transferred or electric power is to be transmitted, releasably attaching the transfer structure to an outer surface of the floating structure with passive-movable attachment means mounted on the transfer structure, providing at least one aerial transfer line between the floating structure and the transfer structure such that a fluid can be transferred between the floating structure and the floating or non-floating facility or such that electric power can be transmitted between the floating or non-floating facility and the floating structure, and flowing a fluid and/or transmitting electric power through the transfer lines connecting the floating structure and the floating or non-floating facility.

Preferably, a vessel is used to relocate the transfer structure between the docking facility, where the transfer structure is moored when it is not in use, and the floating structure, and for positioning and/or controlling the transfer structure during the transfer structure's attachment to or detachment from the floating structure. Alternatively, one or more winches may be used to relocate the transfer structure between the docking facility and the floating structure.

The transfer line may be stored on at least one reel or turntable or basket when the transfer system is not in use. Alternatively, the transfer line may be stored on rollers which the transfer line rests on.

The transfer structure is preferably moored at the docking facility when the transfer system is not in use.

The transfer structure and/or the transfer system as described above can be used for transferring a cryogenic liquid, for example, LNG, between the floating structure and the floating or non-floating facility. The transfer structure and/or the transfer system as described above is/are also useful for transmitting electric power between a floating or non-floating facility and a floating structure.

BRIEF DESCRIPTION OF THE DRAWINGS

Various advantages of the invention will become apparent to those skilled in the art from the following detailed description of a non-limiting embodiment of the present invention, when read in light of the accompanying drawings, wherein.

DETAILED DESCRIPTION OF THE INVENTION

Reference is made to FIGS. 1, 2, 3 and 12, which schematically illustrate a transfer system according to the present invention. A floating structure 1, typically an LNG carrier, is moored to a multi-buoy mooring system 42 comprising a plurality of buoys 7 which are anchored to the sea bottom and spread out such that when the floating structure 1 is moored to the mooring system 42, the floating structure is non-weathervaning, i.e., the floating structure is substantially kept in a given position independently of the direction of wind and waves and/or currents in the water.

Figure 1:
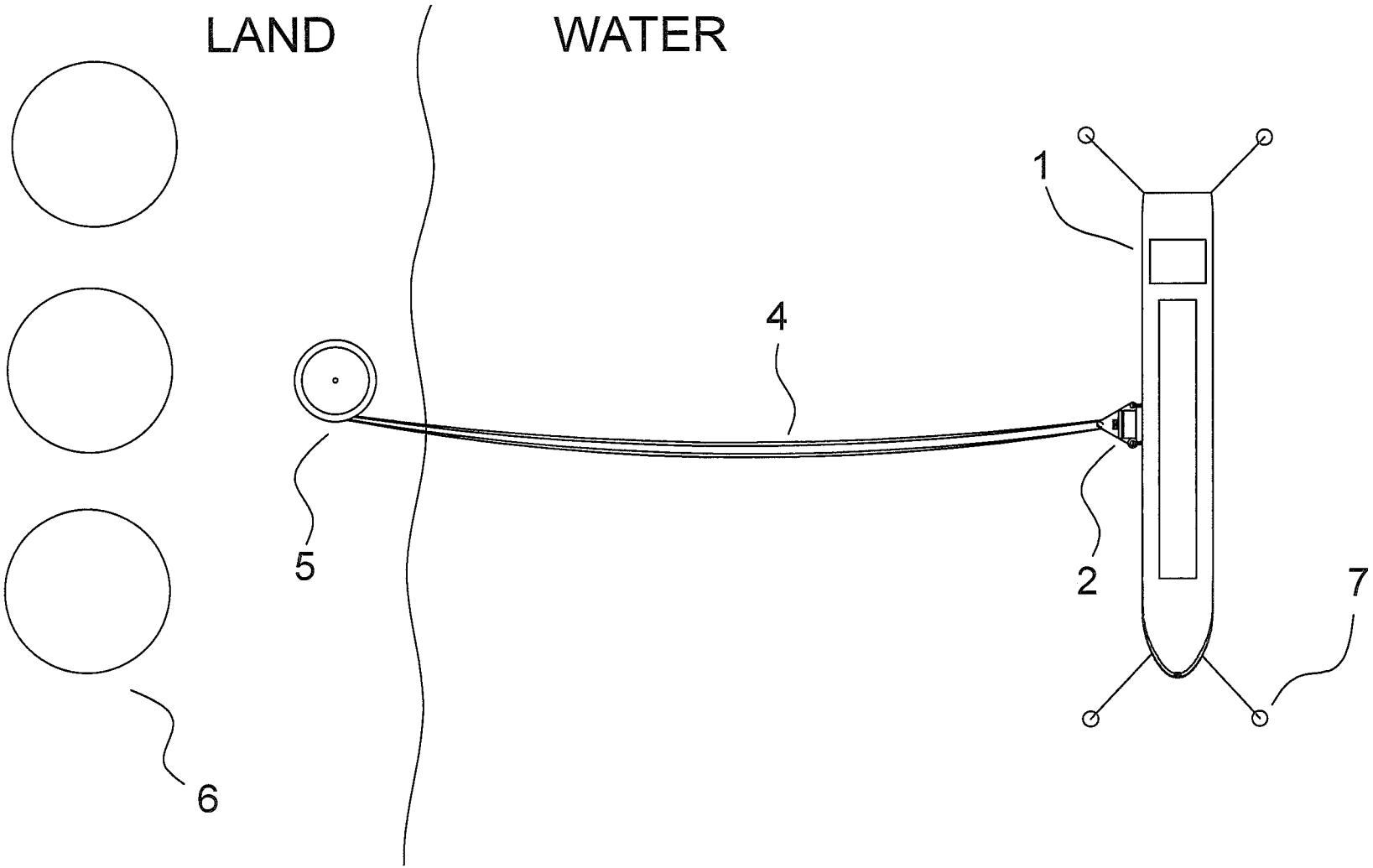
FIG. 1 is a top view of the system layout of a transfer system according to the present invention.

The system further comprises a floating, semi-submersible transfer structure 2 which is shown beside the moored floating structure 1 in FIG. 1. The transfer structure 2 is preferably moored between transfer operations, for example, to a docking station 8, a pier or mooring means. During a transfer operation of fluid or transmitting of electric power, the transfer structure 2 is unmoored and attached temporarily to the floating structure 1.

Figure 12:
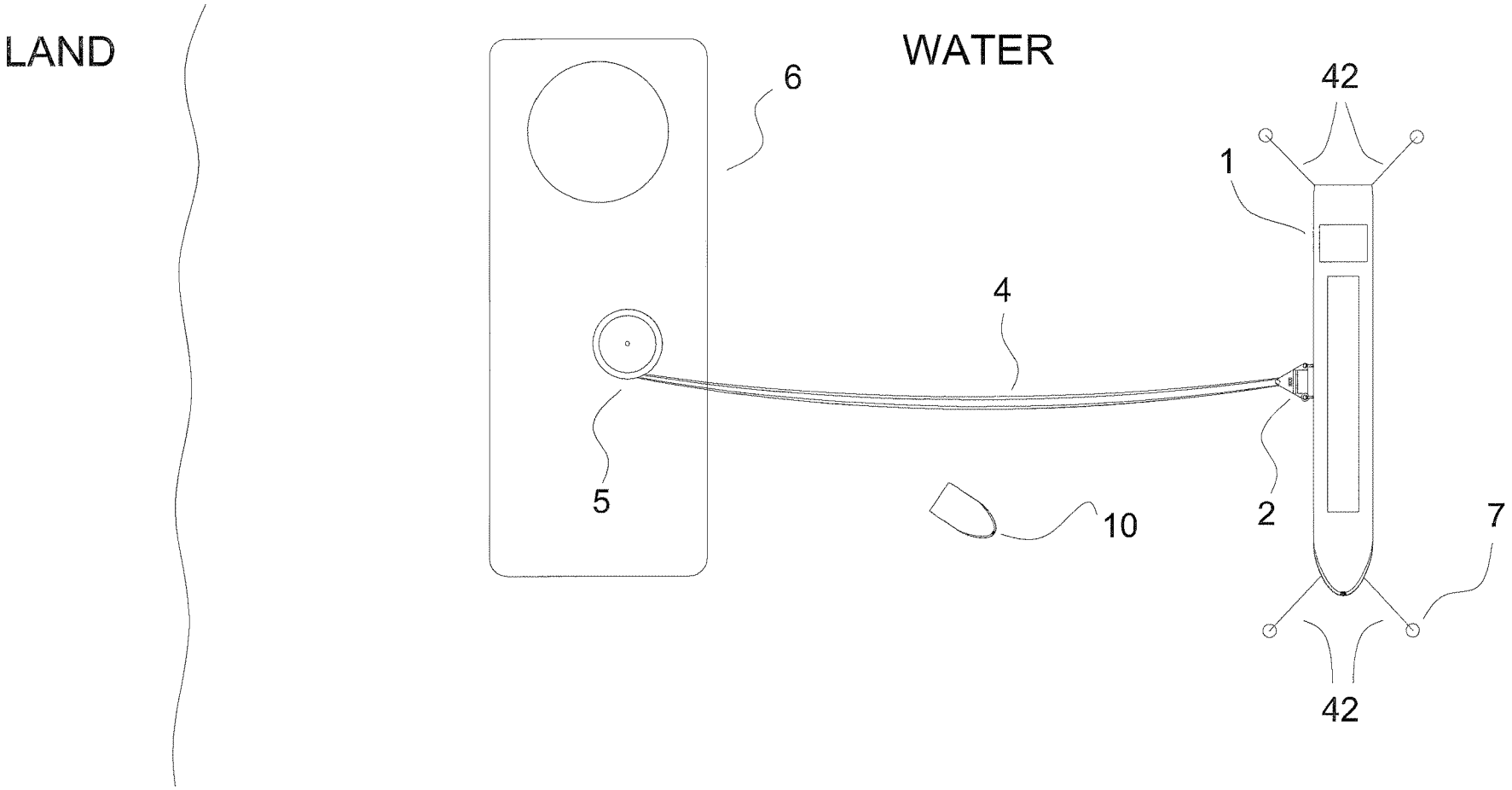
FIG. 12 is a top view of the transfer system according to the present invention, when transferring fluid or electricity to or from a floating facility.

At least one aerial transfer line 3 is provided between the transfer structure 2 and the floating structure 1. The aerial transfer line 3 may be stored on the transfer structure 2 between transfer operations and connected to the floating structure 1 when a transfer operation is to take place. Alternatively, the aerial transfer line 3 may be stored on the floating structure and connected to the transfer structure 2 when a transfer operation is to take place. After the transfer operation, the aerial transfer line 3 may be disconnected again and stored on the transfer structure 2 or the floating structure 1. The aerial transfer line 3 enables transfer of a fluid or electric power between the floating structure 1 and the transfer structure 2. In the figures, the facility is shown as an onshore facility for transfer of a fluid, for example, a cryogenic fluid like LNG, between the floating structure and the onshore facility 6. The facility may, however, be a floating facility as shown in FIG. 12, for example, in the form of a vessel 6 on which a fluid may be stored before or after transfer between the floating structure 1 and the floating facility takes place.

Figure 2:
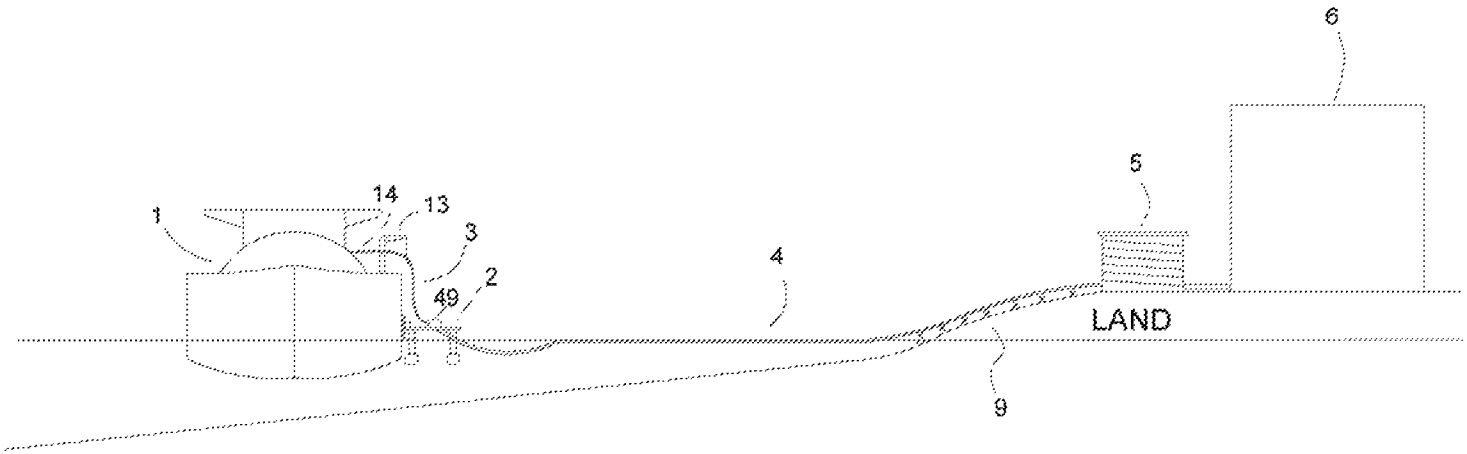
FIG. 2 is a side view of the system layout of a transfer system according to the present invention.
Figure 3:
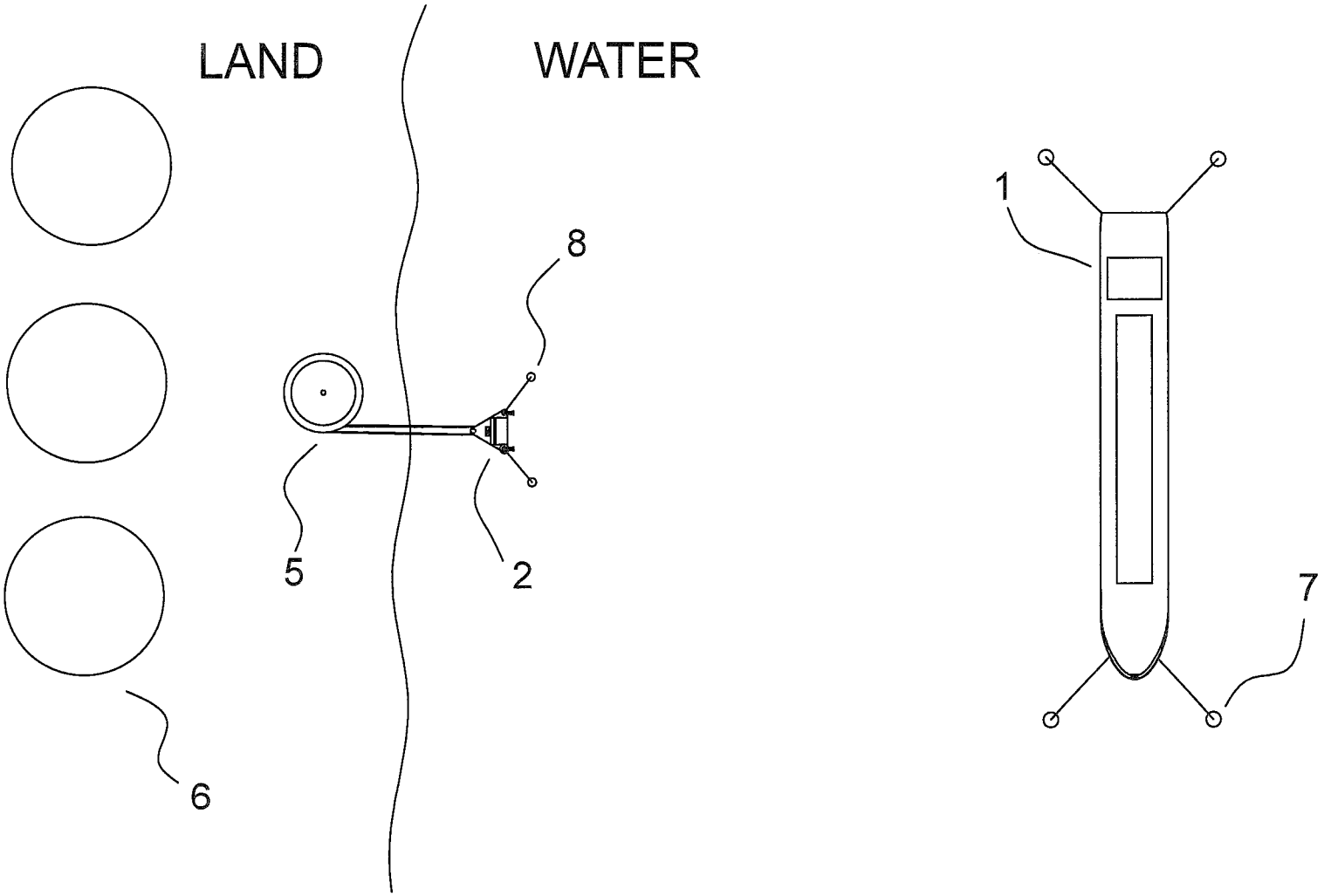
FIG. 3 is a top view of a transfer system with a transfer structure anchored at a docking facility.

The aerial hoses 3 will usually be held in an S shape, for example, by the utilization of a crane 13 on the floating structure 1, as illustrated in FIG. 2. Between transfer operations, the aerial hoses 3 are preferably stored on the transfer structure 2 as mentioned above, easy accessible with regards to outreach capacity on appropriate crane 13 on the floating structure 1.

For transfer of fluid, the transfer system further comprises at least one transfer line 4 in form of a floating, flexible pipe for transfer of fluid between the transfer structure 2 and the floating or non-floating facility 6 shown in the figures. For transfer of electric power, the transfer line 4 and the aerial transfer line are made up of at least one electrical cable or at least comprise an electrical cable.

Figure 11:
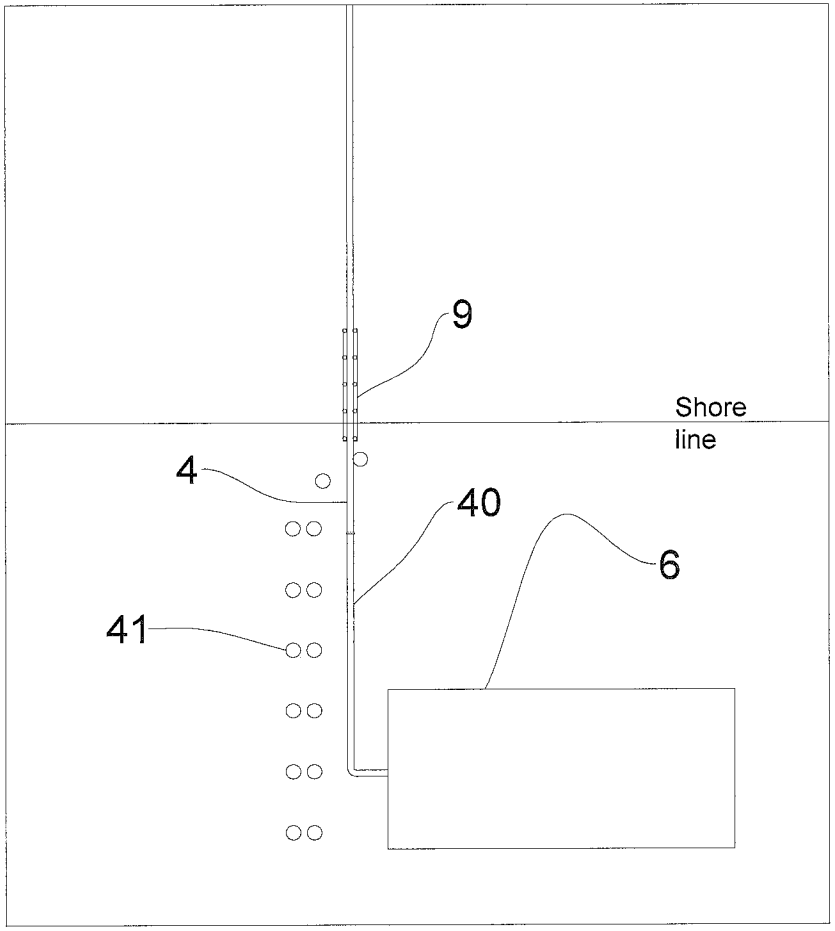
FIG. 11 is a top view of the transfer system shown in FIG. 10 in operation.
Figure 10:
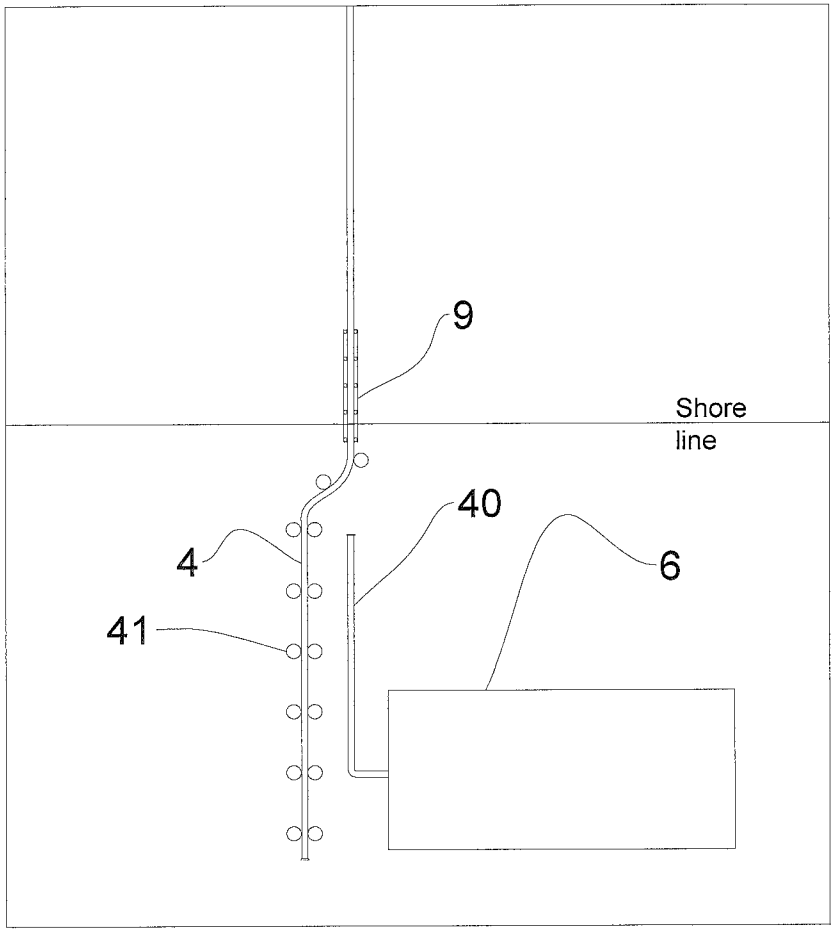
FIG. 10 is a top view of a transfer system according to the present invention wherein the transfer line has been pulled back on rollers during non-operational periods.

As can be seen in FIGS. 1-3 and 12, the transfer system further comprises storage means for storing the at least one transfer line 4 when it is not in operation. The storage means may be in the form of at least one reel 5 as shown in FIGS. 1-3 and 12 such that the transfer line can be wound up on the reel 5. The storage means may also be in the form of a turntable or basket on which the transfer line 4 may be wound, or rollers 41 if the transfer line is to be stored without being wound, i.e., the transfer line is stored in a substantially straight condition, as can be seen in FIGS. 10-11.

As mentioned, the facilitation of fluid transfer between the transfer structure 2 and the storage facility 6 is preferably achieved through at least one floating pipeline 4. The length of the at least one floating pipeline 4 is sufficient to allow the dynamic motion of the floating structure 1 during transfer operation. The at least one floating pipeline 4 may conveniently be stored on a reel or turntable 5 on shore, or on the transfer structure 2 between loading operations, hence reducing the obstruction and potential risk of collision with local sea traffic, increasing fatigue life and simplifying inspection and control of the pipeline. The floating pipeline(s) 4 may be specifically designed for the transfer of temperate or cryogenic fluids or both, and may or may not comprise buoyancy elements, isolation, bending stiffeners 28 and/or opportunity for optical and/or electric transmission.

The storage arrangement 5 may also be linearly or otherwise conveniently arranged, but is generally characterized in that a large fraction of the floating pipeline(s) 4 may be conveniently retrieved from the water and temporarily stored in a designated location. As shown in FIG. 2, the at least one floating pipeline 4 may for convenience be guided on rollers 9 in the sea-shore interface in order to minimize pull-in force and wear and tear on the at least one transfer line.

Since the transfer structure 2 is unmoored and connected to the floating structure 1 during transfer operations, the mooring system 42 for the floating structure 1 must be arranged in such a way that it restricts the lateral motions of the floating structure 1 within the limits of lateral reach of the floating pipelines 4. Single point mooring with weathervaning is therefore not an option. The transfer system therefore preferably comprises a multi-buoy mooring system 42 which will prevent weathervaning, and hence protect the integrity of the floating pipelines 4. The multi-buoy mooring system 42 may vary in configuration and complexity, depending on local environmental conditions, incident water depth, and the size range of floating structures to use the mooring system. The multi-buoy mooring system 42 will typically comprise appropriate anchors depending on seabed conditions, connected to surface buoys by chain or fiber rope or a combination of both.

The transfer system is further provided with a connection between the floating structure 1 and the transfer structure 2 which comprises a mechanical connection arrangement with the capability of producing attractive forces to the hull of the floating structure. The capability of producing attractive forces may preferably be established by sub-atmospheric pressure, for example, by the use of vacuum pads. Other options for establishing the required attractive force may be by electromagnetic attraction, by hawsers, or by a combination of hawsers and fenders.

Without the desire to be bound by theory, it is implicit that the design of the connection of two independent floating structures in any significant seaway must, in an arbitrary degree of freedom, either allow for relative motion between the two structures, or be able to cope with the forces and/or moments resulting from restricting or partially restricting the two structures from moving independently. Any reaction forces or moments must be sufficiently distributed such that the force concentrations do not compromise the structural integrity of the floating structure, the transfer structure, or the connection system itself. The motions of a moored floating structure may conveniently be separated in linear motions, governed by wave excitation, and nonlinear slow drift motions, typically governed by a combination of nonlinear wave excitation and linear wind and current excitation, where linearity and nonlinearity refer to the relationship between excitation frequency and motion frequency. While wave excited motions typically are characterized by small amplitudes and large accelerations, slow drift motions on the other hand are typically characterized by large amplitudes and small accelerations. Furthermore, wave excited motions are often dominated by vertical translation and rotation about a horizontal axis, while slow drift motions act translationally in the horizontal plane and rotationally about a vertical axis. Since the amplitude of the reaction forces and moments related to the restriction of relative motion will be proportional with the relative accelerations, the forces and moments will be largest along degrees of freedom dominated by wave excitation, and since the two floating structures may not drift apart during a transfer operation, the connection arrangement may conveniently substantially freely allow relative motions dominated by wave excitation, while substantially restraining degrees of freedom related to slow drift motions.

Figure 4:
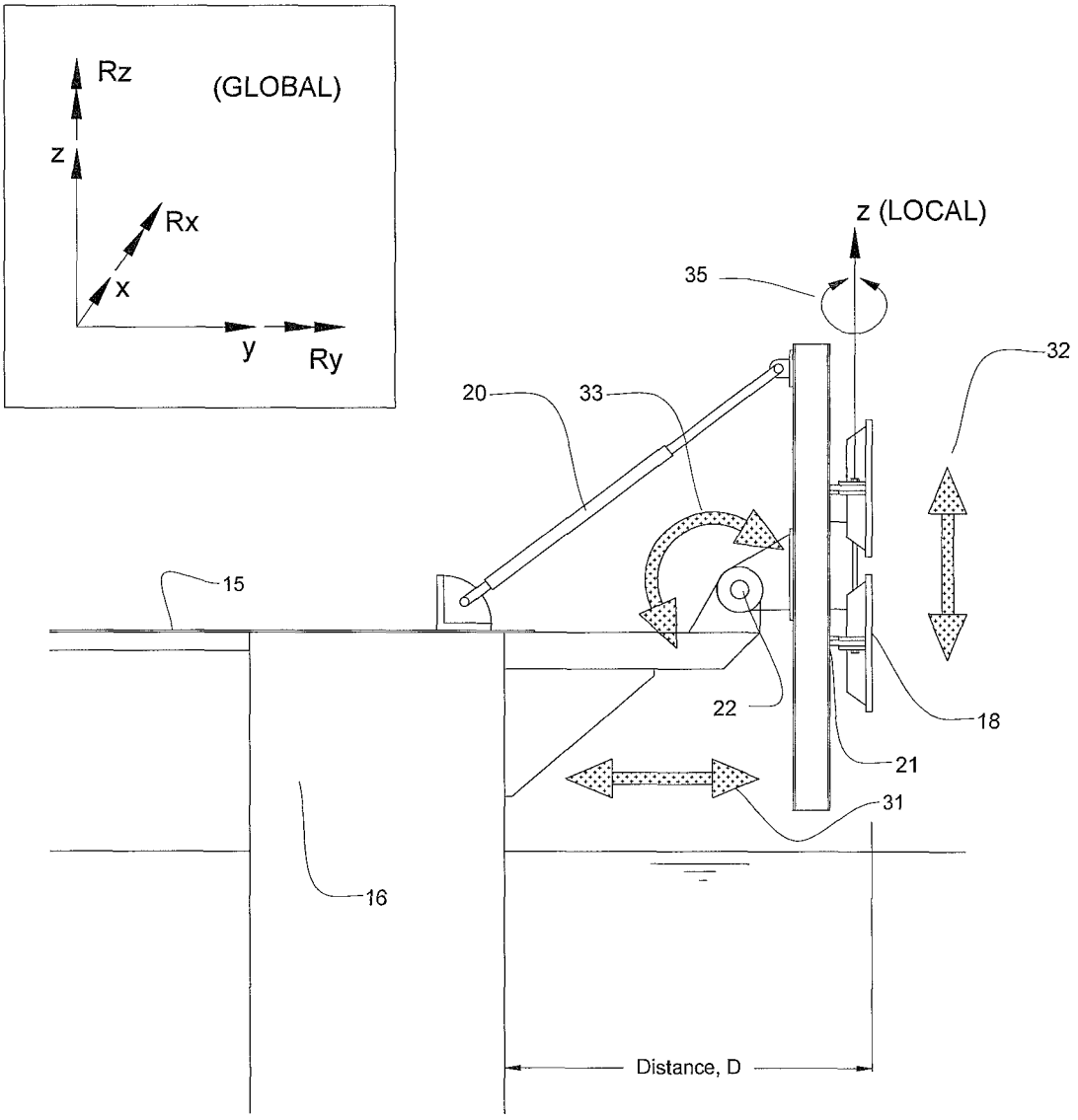
FIG. 4 is a side view of a transfer structure according to the present invention showing possible movements of the transfer structure's passive-movable attachment means.
Figure 5:
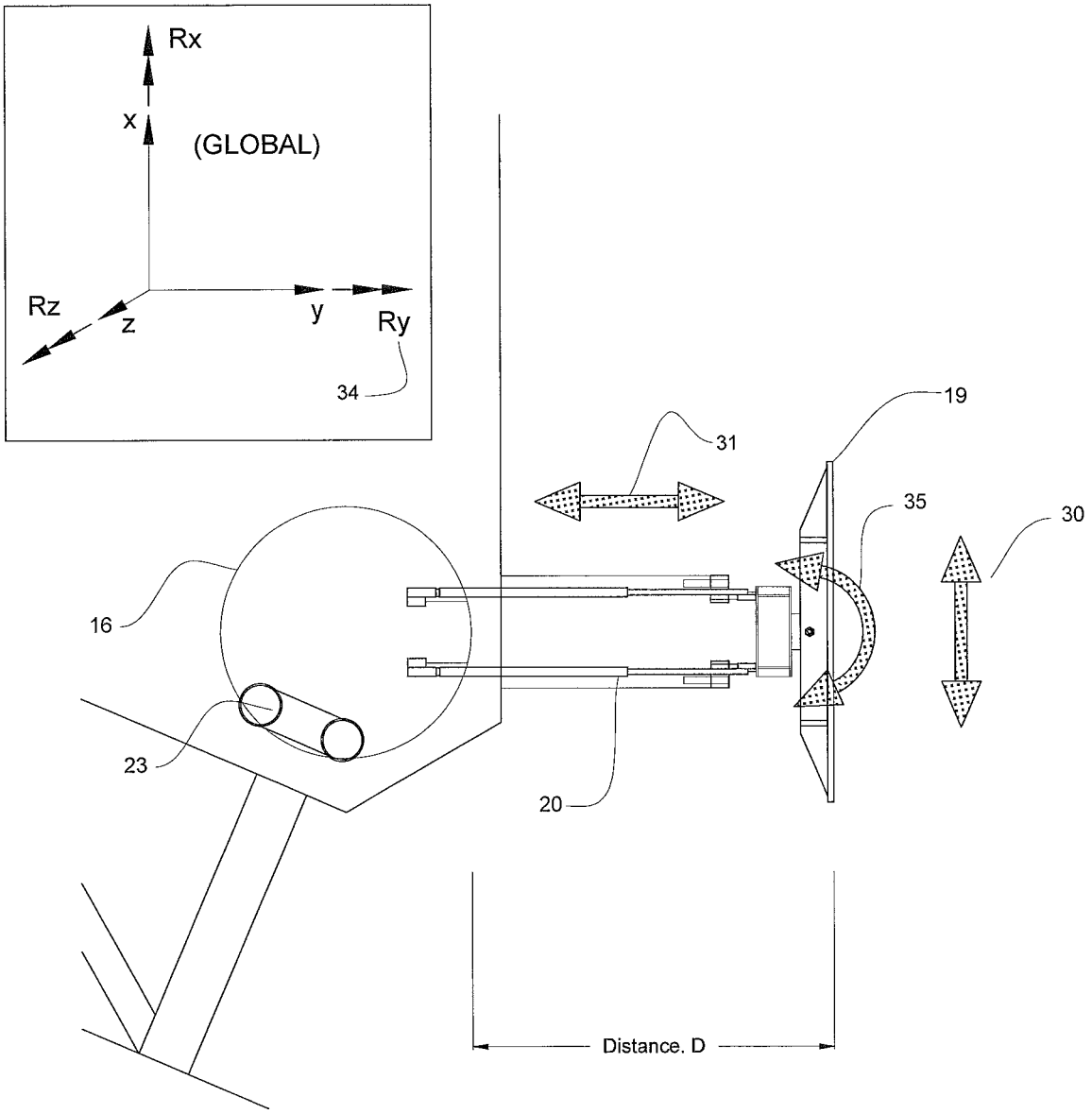
FIG. 5 is a top view of a transfer structure according to the present invention showing possible movements of the transfer structure's passive-movable attachment means.

In FIGS. 4 and 5, is illustrated a specific connection arrangement for releasably attaching the transfer structure 2 to the floating structure 1. Referring to directions as illustrated in FIGS. 4 and 5 with the X-axis 30 defined along the floating structure 2 in a horizontal plane, the Y-axis 31 defined transverse of the floating structure in a horizontal plane, and the Z-axis 32 along the vertical, the connection arrangement enables substantially free relative motion between the floating structure 1 and transfer structure 2 in the Z-direction 32, substantially free relative rotation about an axis parallel to the X-axis 30, and substantially free rotation about an axis parallel to the Y-axis 31, whereas relative rotation about the Z-axis 32 and relative translational motions in the horizontal plane are substantially restricted.

The connection arrangement may typically comprise at least two attachment units 18 placed on the transfer structure 2. Each of the attachment units comprises at least one attachment means, for example, an air or water vacuum pad 19 or electromagnetic pad, for releasable attachment to a substantially vertical side of the floating structure 1, for example, to the shipside if the floating structure 1 is a ship. The connection arrangement comprising the pads 19 is preferably directly attached to the transfer structure 2 with connection means which allows the required relative movements between the transfer structure and the floating structure 1. The pad or pads 19 are mechanically connected to the transfer structure 2 through a beneficial combination of ball and/or disk joints 22 and linear-motion bearings 21 with integrated spring elements and/or damping elements. Each of the pads has opportunity for motion in six degrees of freedom relative to the transfer structure, wherein motion in degrees of freedom X, Y and RZ, as indicated by reference numbers 30, 31 and 35, respectively, in FIG. 5, preferably have inherent spring stiffness and/or damping, while motion in degrees of freedom Z, RX and RY, as indicated by reference numbers 32, 33 and 34, respectively, in Figured 4 and 5, has negligible inherent spring stiffness and damping, wherein the terms substantial and negligible refer to the relation between the spring and damping forces arising from rigid body displacements and velocities of the transfer structure 2 due to wave excitation in the design seaway, and the corresponding excitation forces from waves in the design seaway. For the spring and/or damping elements 20, i.e., the element 20 may comprise a spring element only, a damper element only or a combination of spring and damper elements, and the spring elements may, for instance, be chosen from gas springs, or mechanical springs constructed of elastic materials which have the capability of storing releasable energy upon tension or compression. The damping elements may, for instance, be chosen from dashpots, linear dampers or shock absorbers, made from either a mechanical material such as elastomers or a coil spring, or rely on fluids such as gas, air or hydraulics.

The connection arrangement permits the relative motions in the degrees of freedom with larger relative accelerations between the floating structure 1 and the transfer structure 2 from linear wave excitation, while restricting the smaller accelerations in the lateral plane due to slow drift motions, hence reducing arising connection forces and moments to a manageable level. The free vertical relative motion also allows a certain draft change of the floating structure 1 in case it is loading or offloading cargo. The connection arrangement is permanently installed on the transfer structure 2. It should be emphasized that the connection arrangement described above entails the at least one attachment means being mounted to the transfer structure 2 passive-movably relative to the transfer structure 2 meaning that the at least one attachment means will only move in one or more of its allowed degrees of freedom when external forces and/or moments are acting on the at least one attachment means.

As mentioned above, the transfer system also comprises a transfer structure 2. The transfer structure 2 preferably has a design of a floating structure with several advantageous properties related to the specific purpose of serving as a transfer structure. The following section will briefly discuss the preferred requirements related to the performance and properties of the transfer structure 2.

The partially restricted connection of the two independent floating structures, the floating structure 1 and the transfer structure 2, becomes increasingly difficult with larger relative motions. Large relative motions will complicate the connection operation, contribute to increased fatigue to the end terminations of transfer ducts, and possibly reduce personnel safety and comfort. Since the motions of the floating structure are predefined and cannot be changed, it is important that the motions of the transfer structure are small in the design seaway, for example, less than 0.5 meter heave motion amplitude and less than 5 degree rotational motion amplitude. The transfer operation normally takes place in a reasonably sheltered location, with a significant wave height of, for example, less than 1 meter and a seaway energy spectral peak period of, for example, less than 5 seconds, wherein significant wave height means the statistical mean of the through to crest height of the highest one-third of the waves in the seaway. Since the transfer operation typically takes place near the shoreline, and since it might be beneficial to move the transfer structure closer to shore between transfer operations to reduce the obstruction of local sea traffic, the incident water depth will in most cases pose restrictions on the draft of the transfer structure. The transfer structure must furthermore have sufficient stability to withstand all foreseeable heeling moments. While connected to the floating structure, the transfer structure will encounter heeling moments due to the connection arrangement itself, water drag forces from mean relative water speeds, due to tension in the floating pipelines, in addition to personnel and equipment. The platform might also encounter heeling moments during transit from shore to ship. Hence the water resistance must be small, and the vertical distance from the point of attachment to the floating structure, the water resistance resultant force of the submerged structure, which is related to the draft of the structure, must be small. Additionally, from a cost perspective, keeping the weight to a minimum is important. Thus, the main objective with the design of the transfer structure is to provide a platform with minimal wave excited motions, keeping drag resistance minimal, without considerably compromising stability, low weight or small draft.

From a hydrodynamic and physical point of view this is problematic, since previously mentioned parameters are profoundly dependent on each other. The water particle motion and dynamic pressure field under a wave declines exponentially downward in the water column, and hence the local wave excitation of a floating object also declines with depth. Thus, the wave-induced response of a floating structure generally decreases with increasing draft. From hydrodynamic theory, it is known that small linear wave induced motion response of a floating object is achieved by arranging submerged geometry, structure weight and distribution of weight, in such a way that its natural frequencies of motion lie well outside the interval of wave frequencies with dominating energy in the considered seaway. For a freely floating object, this may effectively be achieved in heave by reducing the waterplane area, and in roll/pitch by reducing transverse/longitudinal stability sufficiently. Other parameters fixed, all natural frequencies of a floating object decrease with decreasing weight. Hence, small first order motions are generally achieved at the expense of stability, weight, draft, or a combination of the above. The present design has been created for the sole purpose of optimally satisfying the above-mentioned criteria for the present purpose.

Figure 6:
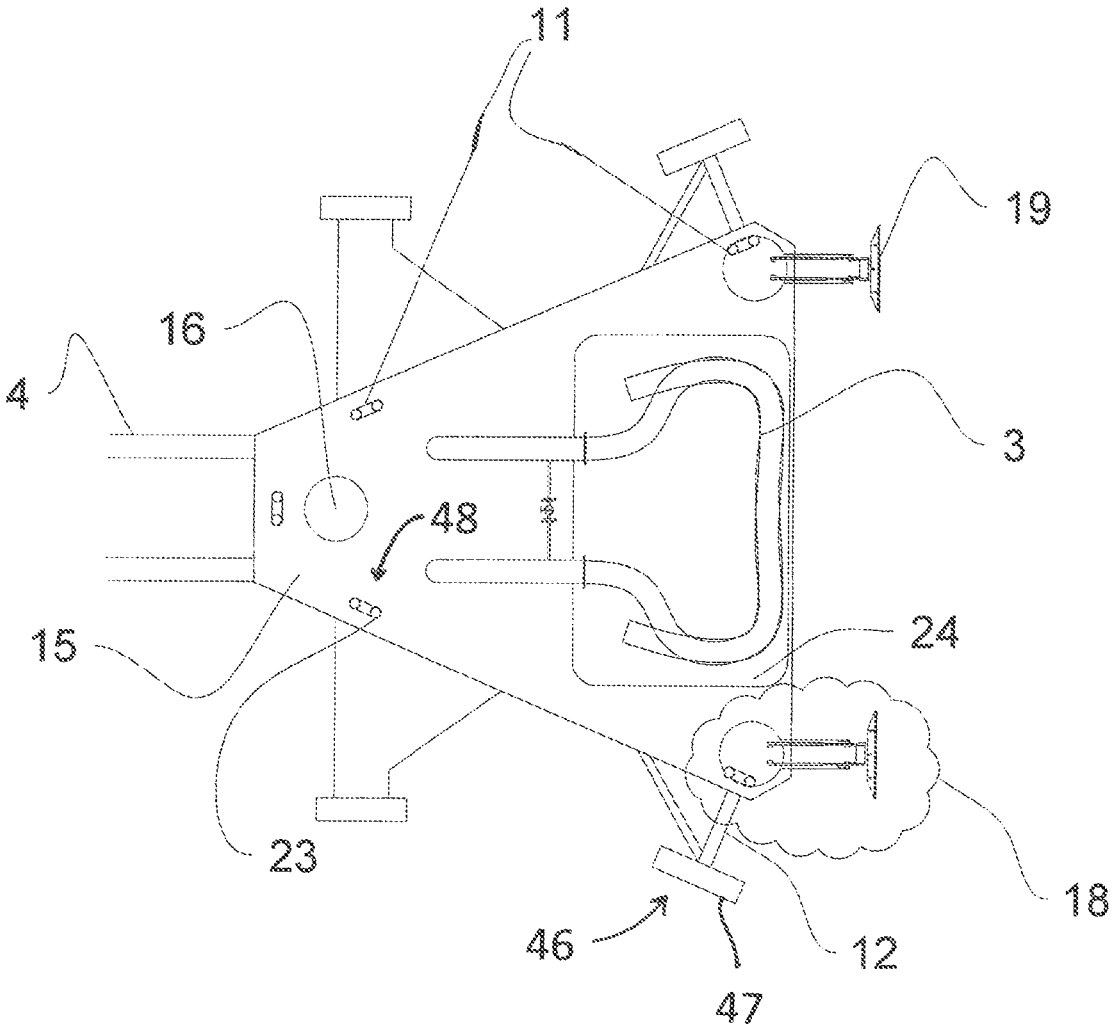
FIG. 6 is a top view of a transfer structure according to the present invention.
Figure 7:
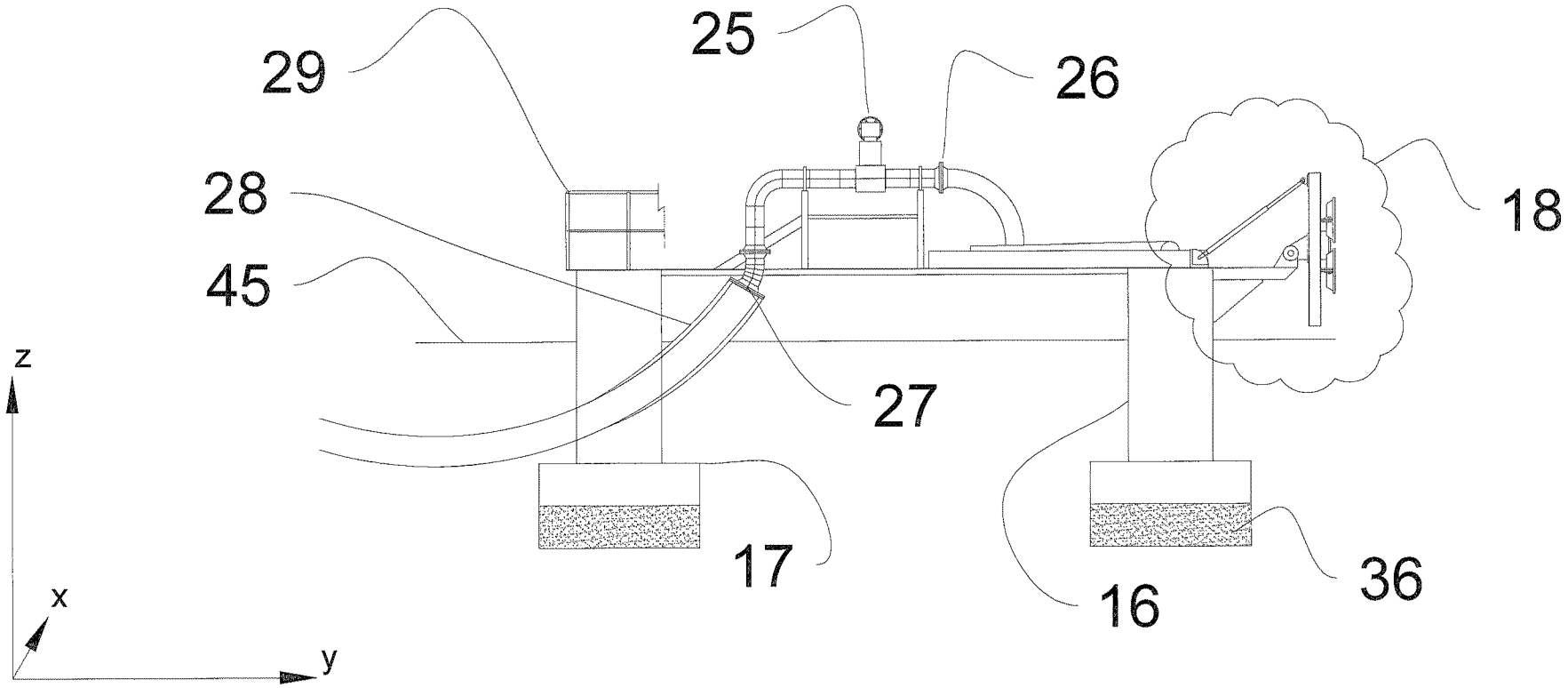
FIG. 7 is a side view of a transfer structure according to the present invention.

FIGS. 6 and 7 conceptually illustrate the transfer structure 2, being partially submerged below a water surface 45, with a small waterplane area to displacement ratio, and a small waterplane area to second moment of inertia ratio about a roll or pitch axis relative to most other floating concepts. Three surface piercing columns 16 provide buoyancy and support a topside deck structure 15 with all relevant topside equipment. The columns 16 are preferably triangularly positioned in a horizontal plane, with an internal distance of, for example, 7.5 times the diameter of one column, and may, if required, be interconnected with bracings. The cross section of the columns may be circular or oval or polygonal or otherwise conveniently shaped. The transfer structure 2 is preferably provided with means for increasing the added mass and damping. Each column 16 may at a draft of approximately two times the significant wave height in the design seaway, for example, at two meters depth, be extruded radially for increased buoyancy and viscous damping.

Figure 8:
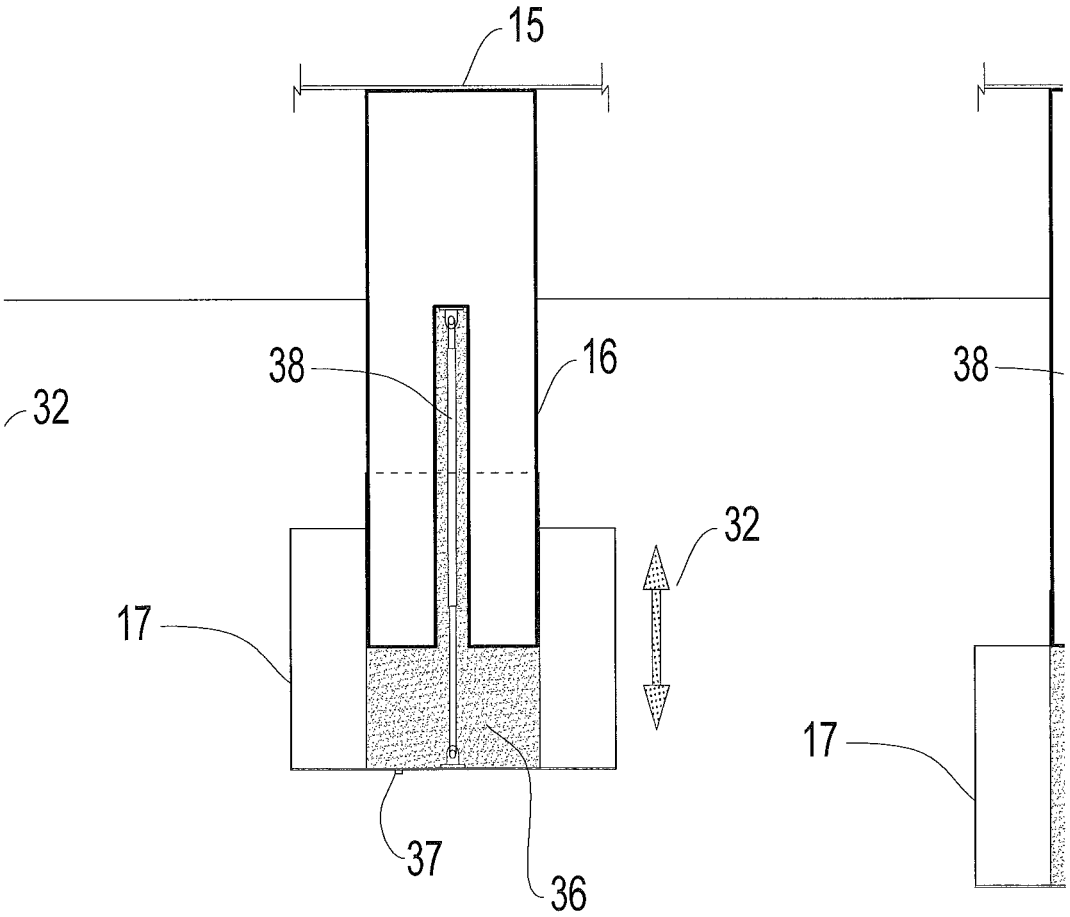
FIG. 8 is a side view of a telescopic column of a transfer structure according to the present invention which includes a piston/cylinder arrangement in order to effectuate telescopic movement.

As shown in FIG. 8, the cavity of each column 16 may be filled with ballast 36 to stabilize the transfer structure 2. The ballast 36 may consist of water or any ballast material including but not limited to, scrap steel, copper ore, or other dense ores.

The transfer structure 2, comprising a top-side deck 15 and a plurality of surface piercing columns 16, may have columns 16 which are provided with respective telescopic elements, for example, extrusions, at their lower end portions, the telescopic elements being movable between an upper position and a lower position such that the columns' respective longitudinal lengths are adjustable. At least one submerged extrusion 17 is shown in FIG. 7 and may be abrupt or gradual and may or may not have a circular cross-sectional shape. The total draft of the transfer structure 2 is advantageously between 2 and 4 times the significant wave height of the design seaway. The transfer structure 2 shown in the figures has a triangular shape, but may also be provided with a different shape, for example, a square or rectangular shape, then preferably with four columns.

Figures 9A, 9B, 9C:
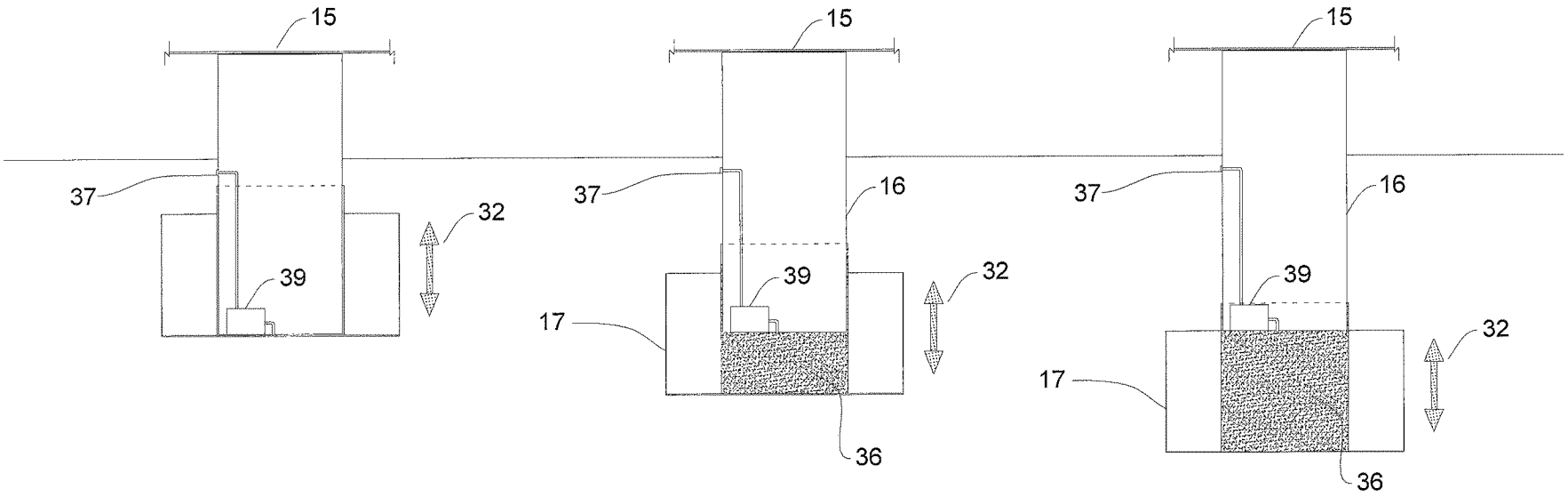
FIGS. 9*a*-9*c* are side views of a telescopic column of a transfer structure according to the present invention which includes a pump in order to effectuate telescopic movement.

The columns may be provided with a storage room for a fluid, for example, in the form of the void space of the submerged extrusion 17 of the transfer structure column, each storage room being delimited by their respective columns and telescopic elements such that the storage room's volume is variable and depends on the vertical position of the telescopic element relative to the column 16. As shown in FIG. 8, the void space of the submerged extrusion 17 of the transfer column may, for example, be filled with seawater 36 with a horizontally equivalent pressure column as the external seawater, by free passage of water from the extrusion void space to surrounding seawater, for instance, through an opening or valve 37. The submerged extrusion 17 is preferably free to move vertically along the column 16, hence providing a variable volume of the void space within the submerged extrusion 17 which makes it possible to change the draft of the transfer structure 2 without changing the freeboard height. The vertical movement of the submerged extrusion 17 may, for instance, be achieved by the utilization of a hydraulic rod 38 as shown in FIG. 8. Alternatively, a pump 39 may be provided in order to fill and/or empty the void space with the submerged extrusion 17 as shown in FIGS. 9*a*-9*c*. The draft change arrangement will enable maneuvering in shallow waters, and small wave excited response during transfer, while maintaining adequate stability in and in-between both draft modes.

The transfer structure 2 may or may not be motorized for expedient transit. Furthermore, the transfer structure 2 may be provided with berth means 46 and anchoring means 48, the berth means 46 including a truss structure 12 (see FIG. 6) comprising fender(s) 47 for the berthing of an assistance vessel 10 for relocating a transfer vessel between the docking facility and the floating structure and for control of the assistance vessel 10 during attachment to or detachment from the floating structure. The assistance vessel 10 may be a tug or workboat (see FIG. 12) with hawsers 11 to attach for push or pull of the transfer structure 2. As indicated in FIG. 6, the transfer structure 2 may further be provided with anchoring means 48, for example attachment means for one or more winch wires in the form of cleats, bitts, or bollards 23. Moreover, the transfer structure 2 will support rigid piping for facilitation of fluid transfer between the aerial hoses and the floating hoses 4, and may, among other items, support various types, configurations and numbers of valves 25, emergency release couplings, a drip tray 24, pumps, hose cradles, marine signals and lights, and safety equipment.

The particular design described herein has through extensive experimental tests proven superior properties with regard to all above-discussed requirements as compared to several previously known floating concepts.

Reference numbers used in the figures:

1. First floating structure, such as an LNG carrier
2. Transfer platform
3. Aerial hose(s)
4. Floating pipeline(s) or transfer line(s)
5. Storage arrangement for transfer lines(s)
6. Floating or non-floating storage, receiving or export facility
7. Mooring buoys
8. Idle mooring system or docking facility for transfer platform
9. Guiding rollers for transfer line(s)
10. Assistance vessel
11. Hawsers for berthing of tug or workboat to the transfer platform
12. Truss structure
13. Crane to connect and support aerial hose(s)
14. First floating structure manifold
15. Transfer platform topside deck
16. Transfer platform columns
17. Submerged extrusion(s)
18. Attachment unit
19. Pads for shipside attachment
20. Spring and/or damper element
21. Linear motion bearings
22. Disk or ball joint
23. Cleats, bitts, or bollards
24. Drip tray
25. Valve
26. Flange
27. Transfer line tie in
28. Transfer line bending stiffener
29. Railing
30. X-direction of motion
31. Y-direction of motion
32. Z-direction of motion
33. Rotation about the X-axis
34. Rotation about the Y-axis
35. Rotation about the Z-axis
36. Ballast water
37. Opening or valve
38. Hydraulic rod
39. Ballast water pump
40. Rigid piping in connection with storage tanks
41. Storage arrangement for floating pipeline(s) on rollers
42. Multi-buoy mooring system
45. Water surface
46. Berth means
47. Fender(s)
48. Anchoring means
49. Connecting device

The invention claimed is:

1. A transfer structure for transfer of a fluid, through at least one transfer line and at least one aerial transfer line, between a non-weathervaning floating structure and a facility or transmission of electric power between the facility and the floating structure, the transfer structure comprising:

a connecting device to which the at least one aerial transfer line can be releasably connected, the connecting device being adapted for connection to the at least one transfer line; and at least one attachment means mounted directly to the transfer structure for releasable attachment of the transfer structure to the floating structure, wherein:

the at least one transfer line extends between the transfer structure and the facility during transfer of the fluid and the at least one aerial transfer line extends between the transfer structure and the floating structure during transfer of the fluid;

the transfer structure is semi-submersible and floating;

the transfer structure is configured to absorb tensional forces in the at least one transfer line arising from environmental loads acting on the at least one transfer line and distribute the tensional forces through the at least one attachment means to a hull of the floating structure to which the at least one attachment means is attached during transfer of the fluid; and the at least one attachment means is passive-movably mounted relative to the transfer structure, the at least one attachment means is adapted to allow the transfer structure to move substantially freely vertically and to rotate substantially freely about a horizontal axis relative to the floating structure, and the at least one attachment means is further adapted to passively substantially restrain relative horizontal translation and relative rotation about a vertical axis between the floating structure and the transfer structure.

2. The transfer structure according to claim 1,
wherein the transfer structure is adapted for relocation and positioning by an assistance vessel.

3. The transfer structure according to claim 1,
wherein the transfer structure is provided with berth means and anchoring means for a vessel.

4. The transfer structure according to claim 1,
further comprising a top-side deck and a plurality of surface piercing columns each having a diameter, or a characteristic diameter, the surface piercing columns being separated by a distance which is at least four times as large as the diameter or the characteristic diameter.

5. The transfer structure according to claim 1,
further comprising a top-side deck and a plurality of surface piercing columns, the surface piercing columns being provided with respective telescopic elements at lower end portions of the surface piercing columns, each of the telescopic elements being movable between an upper position and a lower position such that respective longitudinal lengths of the surface piercing columns are adjustable.

6. The transfer structure according to claim 5,
wherein at least one of the surface piercing columns is provided with a storage room for a fluid, the storage room being delimited by the at least one of the surface piercing columns and the telescoping element of the at least one of the surface piercing columns such that a volume of the storage room is variable and depends on a vertical position of the telescopic element of the at least one of the surface piercing columns relative to the at least one of the surface piercing columns.

7. The transfer structure according to claim 6,
wherein the storage room is provided with at least one opening or valve to the surroundings such that water can flow in and out of the storage room.

8. The transfer structure according to claim 1,
wherein the transfer structure has a maximum draft in still water which is less than 5 meters.

9. The transfer structure according to claim 1,
wherein the connecting device is a manifold to which the at least one transfer line and the at least one aerial transfer line can be connected for the transfer of fluid between the floating structure and the facility, or the connecting device is an electrical coupling device to which the at least one transfer line and the at least one aerial transfer line can be connected for the transmission of electrical power between the facility and the floating structure.

10. The transfer structure according to claim 1,
wherein the transfer structure is a shallow-water transfer structure.

11. The transfer structure according to claim 1,
wherein the transfer structure is non-motorized.

12. The transfer structure according to claim 1,
wherein the facility is floating.

13. The transfer structure according to claim 1,
wherein the facility is non-floating.

14. The transfer structure according to claim 1, wherein:
the at least one transfer line extends from a lower side of the transfer structure;
the at least one aerial transfer line extends from an upper side of the transfer structure; and
the lower side of the transfer structure is opposite to the upper side of the transfer structure.

15. A transfer system for transfer of a fluid between a floating structure and a facility or transmission of electric power between the facility and the floating structure,
the transfer system comprising a transfer structure according to claim 1, at least one transfer line, and a storage means for storing the at least one transfer line when the transfer system is not in use, the at least one transfer line extending between the transfer structure and the storage means, and the at least one transfer line being connected to:
a storage means for the fluid which has been transferred from the floating structure or which is being transferred to the floating structure, or
a pipeline for the fluid which has been transferred from the floating structure or which is being transferred to the floating structure, or
a source of electric power for the transmission of electric power to or from the floating structure.

16. The transfer system according to claim 15,
further comprising a docking facility for storing the transfer structure when the transfer structure is not in use.

17. The transfer system according to claim 16,
further comprising an assistance vessel for relocating the transfer structure between the docking facility and the floating structure and for control of the transfer structure during attachment to or detachment from the floating structure.

18. The transfer system according to claim 15,
wherein the at least one transfer line is flexible and the storage means for storing the at least one transfer line comprises at least one reel or turntable or basket on which the at least one transfer line is wound when the transfer system is not in use.

19. The transfer system according to claim 15,
wherein the storage means for storing the at least one transfer line comprises a plurality of rollers on which the at least one transfer line may be pulled back to a storage position without being wound when the transfer system is not in use.

20. The transfer system according to claim 15,
wherein the storing means for storing the at least one transfer line is located onshore, on a non-floating structure or on a floating structure.

21. The transfer system according to claim 15,
wherein the facility is floating.

22. The transfer system according to claim 15,
wherein the facility is non-floating.

23. A method of transferring a fluid between a floating structure and a facility or transmitting electric power between the facility and the floating structure, the method comprising:
mooring the floating structure to a multi-buoy mooring system such that the floating structure is non-weather-vaning,
relocating a transfer structure according to claim 1 from a docking facility to the moored floating structure, and subsequently or simultaneously paying out a transfer line through which the fluid is to be transferred or the electric power is to be transmitted, releasably attaching the transfer structure to an outer surface of the floating structure with passive-movable attachment means mounted on the transfer structure, providing at least one aerial transfer line between the floating structure and the transfer structure such that the fluid can be transferred between the floating structure and the facility or such that the electric power can be transmitted between the facility and the floating structure, and transferring the fluid or transmitting the electric power through the transfer line and the at least one aerial transfer line connecting the floating structure and the facility.

24. The method according to claim 23, wherein an assistance vessel is used to relocate the transfer structure between the docking facility and the moored floating structure and to position the transfer structure before attachment to or detachment from the floating structure.

25. The method according to claim 23, wherein the transfer line is stored on at least one reel or turntable or basket when the transfer structure is not in use.

26. The method according to claim 23, wherein the transfer structure is stored in or is made fast to the docking facility when the transfer structure is not in use.

27. The method according to claim 23, wherein the facility is floating.

28. The method according to claim 23, wherein the facility is non-floating.

* * * * *